United States Patent [19]

Sprecher

[11] Patent Number: 4,869,134

[45] Date of Patent: Sep. 26, 1989

[54] CAN OPENING TOOL

[76] Inventor: Melvin R. Sprecher, 4306 Ashville Dr., Garland, Tex. 75041

[21] Appl. No.: 905,279

[22] Filed: Sep. 9, 1986

[51] Int. Cl.[4] ..... B67B 7/44

[52] U.S. Cl. ..... 81/3.09; 81/3.55; 7/151; 30/400

[58] Field of Search ..... 30/400; 81/3.47, 3.41, 81/3.09, 3.55; 7/151

[56] References Cited

U.S. PATENT DOCUMENTS

| | | | |
|---|---|---|---|
| 4,207,781 | 6/1980 | Greenwood . | |
| 4,241,626 | 12/1980 | Hall . | |
| 4,309,921 | 1/1982 | Miller . | |
| 4,362,071 | 12/1982 | Coker . | |
| 4,373,223 | 2/1983 | Miller . | |
| 4,373,246 | 2/1983 | VanHoutte . | |
| 4,391,167 | 7/1983 | Bergmeister . | |
| 4,409,863 | 10/1983 | Anderson . | |
| 4,409,864 | 10/1983 | Gaskins . | |
| 4,412,464 | 11/1983 | Cook . | |
| 4,414,865 | 11/1983 | Brooks . | |
| 4,416,171 | 11/1983 | Chmela et al. . | |
| 4,455,894 | 6/1984 | Roberts . | |
| 4,455,895 | 6/1984 | Christensen . | |
| 4,667,544 | 5/1987 | Milo | 81/3.55 |

*Primary Examiner*—Frank T. Yost
*Assistant Examiner*—Willmon Fridie, Jr.
*Attorney, Agent, or Firm*—Daniel V. Thompson

[57] ABSTRACT

An improved can opening tool for opening a can having a pull tab is provided. The tool includes a ring member and an arm attached to the ring member having a bent end. An index finger is snugly engaged by the ring member, with the end of the arm engaged with the pull tab for imparting a pulling force to the pull tab.

6 Claims, 1 Drawing Sheet

CAN OPENING TOOL

TECHNICAL FIELD

The present invention relates to apparatus for opening cans having tabs, and more particularly to a pull tab can opener tool.

BACKGROUND ART

Cans having pull tabs are commonly used as containers for beverages such as soft drinks and the like. One type of pull tab closure presently in use includes a peripherally weakened closure member integrally formed in the top of the can, with the pull tab acting to push the weakened member into the can and the pull tab remaining attached to the can. This type of closure arrangement has the advantage that the pull tab is not removable from the can. A disadvantage of this kind of closure member is that the pull tabs are spaced a very small distance away from the top of the can and require substantial effort to pull to an opening position.

Thus, a need has arisen for a can opener tool for opening pull tabs of the afore-described type, as well as conventional removable pull tabs.

SUMMARY OF THE INVENTION

The present invention provides an improved can opening apparatus having a generally cylindrical ring member for snug engagement with a human index finger. Attached to the ring member is an arm which extends outwardly from the ring member in a direction perpendicular to the axis of the ring member. The end of the arm is bent to an acute angle with the arm to provide a pull tab engaging end.

BRIEF DESCRIPTION OF THE DRAWINGS

A more complete understanding of the invention and its advantages will be apparent from the Detailed Description taken in conjunction with the accompanying Drawings in which.

DETAILED DESCRIPTION

Figure 1:
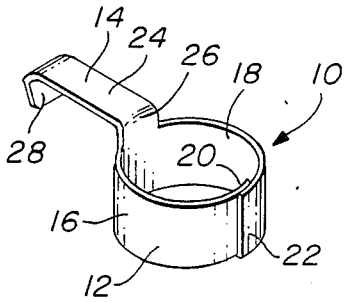
FIG. 1 is a perspective view of the tool of the present invention.
Figure 3:
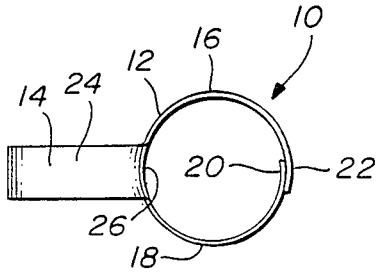
FIG. 3 is a top view of the tool of FIG. 1.
Figure 2:
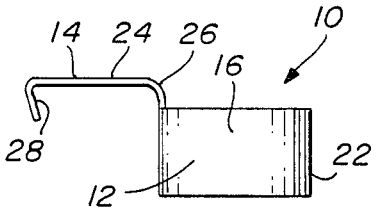
FIG. 2 is a side view of the tool of FIG. 1.
Figure 4:
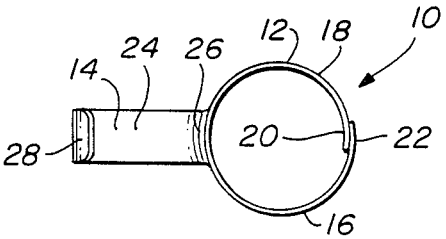
FIG. 4 is a bottom view of the tool of FIG. 1.

Referring initially to FIGS. 1, 2, 3 and 4, tool 10 includes a ring member 12 and arm 14. Ring member 12 is formed of two semi-cylindrical members 16 and 18 with overlapped end portions 20 and 22 respectively. Thus, it can be seen that ring member 12 is formed of members 16 and 18, which have partially circular cross sections. The radii of the cross sections are sized such that ring member 12 snugly encircles a human index finger.

Arm 14 includes a flat rectangular member 24 extending perpendicularly to the central axis of the tube formed by portions 16 and 18. A semi-cylindrical connection portion is provided to attach the flat rectangular member 24 to a small portion of the edge of ring member 12. End 28 of arm 14 is bent to form an acute angle with respect to flat rectangular member 24. In the preferred embodiment, the angle between end 28 and flat rectangular portion 24 is between 45° and 90°.

Figure 5:
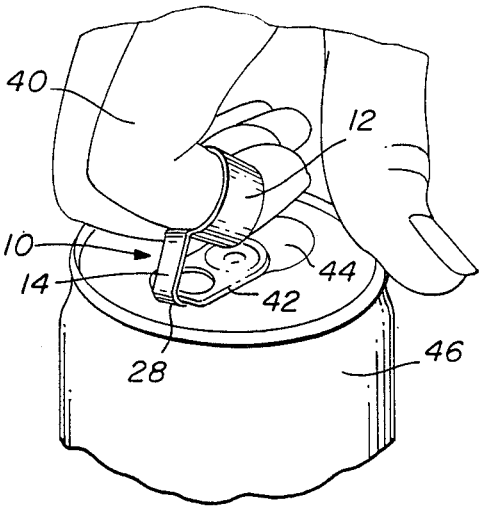
FIGS. 5 and 6 are perspective views illustrating the tool of the present invention in operation.
Figure 6:
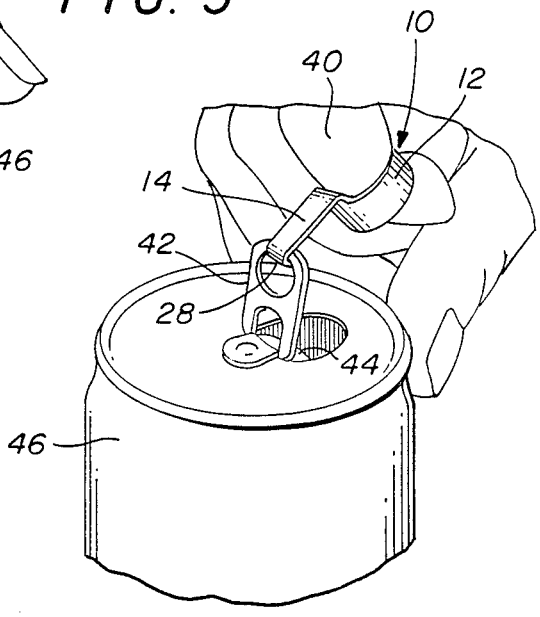

The operation of tool 10 is illustrated in FIGS. 5 and 6. Index finger 40 is snugly encircled by ring member 12 of tool 10. Pull tab 42 is attached to peripherally weakened closure member 44 integrally formed in the top of can 46. End 28 engages pull tab 42 as shown in FIG. 5. With the other fingers braced against the side of can 46, finger 40 is then flexed to impart a firm pulling force upon pull tab 42 through arm 14.

While only one embodiment of the present invention has been described in detail herein and shown in the accompanying drawings, it will be evident that various further modifications are possible without departing from the scope of the invention.

I claim:

1. A can opener tool for opening a can having a pull tab attached to a peripherally weakened closure member integrally formed in the top of said can, the pull tab remaining permanently affixed thereto after opening, the tool comprising:

a ring member having at least partially circular cross sections and sized to snugly encircle a human index finger;

an arm rigidly attached to and extending from said ring member; and means for engaging a pull tab disposed on the end of said arm wherein said means for engaging is the end of said arm being bent to form an acute angle with respect to said arm.

2. The tool of claim 1 wherein said ring member includes inner and outer semi-cylindrical walls forming a tube open at the ends thereof, such that a human index finger may pass therethrough and engage said inner semi-cylindrical walls.

3. The tool of claim 2 wherein said tube includes first and second semi-cylindrical members with overlapped end portions.

4. The tool of claim 2 wherein said arm includes a flat rectangular member extending perpendicularly from said ring member.

5. The tool of claim 4 wherein said arm further includes a semi-cylindrical connection portion between said flat rectangular member and an end portion of said ring member.

6. A can opening tool, comprising:

a ring member formed of two semi-cylindrical members having overlapped end portions, each semi-cylindrical member having partially circular cross-sections about a central axis to form a tube;

an arm including a flat rectangular member extending perpendicularly to the central axis and being connected to an edge of the ring member by way of a semi-cylindrical connection portion; and the arm further including an end being bent to form an acute angle with respect to the flat rectangular member.

* * * * *